United States Patent [19]

De la Concha

[11] 4,109,438

[45] Aug. 29, 1978

[54] REINFORCED SEPARABLE SECTIONAL HERMETIC PROTECTIVE COVERING

[76] Inventor: Francisco De la Concha, Emerson No. 116, Colonia Polanco, Mexico City, Mexico

[21] Appl. No.: 502,660

[22] Filed: Sep. 4, 1974

[30] Foreign Application Priority Data

Aug. 31, 1973 [MX] Mexico ..... 145890

[51] Int. Cl.[2] ..... E04C 2/32

[52] U.S. Cl. ..... 52/630

[58] Field of Search ..... 52/738, 739, 335, 336, 52/339, 450, 630, 86, 634, 588

[56] References Cited

U.S. PATENT DOCUMENTS

| | | | |
|---|---|---|---|
| 3,381,432 | 5/1968 | Brandwein | 52/86 X |
| 3,397,497 | 8/1968 | Sheu et al. | 52/334 |
| 3,812,636 | 5/1974 | Albrecht et al. | 52/336 X |
| 3,820,295 | 6/1974 | Folley | 52/630 X |
| 3,902,288 | 9/1975 | Knudson | 52/86 |

*Primary Examiner*—Price C. Faw, Jr.
*Assistant Examiner*—Carl D. Friedman
*Attorney, Agent, or Firm*—Roylance, Abrams, Berdo & Farley

[57] ABSTRACT

Improved sectional or modular element for use in construction of or as a hermetically sealed protective coverings. The sectional or modular element comprises a main covering portion and lateral portions integral therewith and extending along opposite sides thereof. The main covering portion and the lateral portions integral therewith are characterized by corrugations formed therein to impart strength and rigidity thereto.

3 Claims, 5 Drawing Figures

REINFORCED SEPARABLE SECTIONAL HERMETIC PROTECTIVE COVERING

This invention relates to improvements in reinforced separable sectional or modular members for use in fabricating roofs or walls, and can further be substituted for the core or skeleton portion in the construction of vaults. Moreover, these members may be employed in the construction of tanks, to hold walls, etc., because they possess adequate rigidity enabling them to cover great expanses with a minimum aid of structural complementary elements without the necessity of making holes in them to fix them for connection to the supporting structure. They are characterized in being in modular form with a series of transverse corrugations or deformations on surface portions thereof which serve as a reinforcement and direct the load toward the raised flanges extending along opposite sides of each member to provide a dual function, namely to serve as a supporting beam and as a sealing profile when employed together with other members united thereto by means of a complementary piece. This piece, in turn, covers the corresponding anchoring pieces. Said modules have several advantages over the coverings available to the public at present.

Applicant according to the present invention has significantly improved the known module or covering by providing a series of corrugations thereon that increase greatly the resistance of the covering member.

According to the present invention new covering members are made with units of plate or forged or cast pieces, etc., which may be placed together beside each other, and united by lateral flanges thereof. These members can be placed horizontally or vertically or inclined according to the needs of the construction in which they will be used.

These covering members have a semirectangular or grooved form with a series of corrugations on the surface of the widest portion thereof. These corrugations are transversal to the longitudinal axis of the members and serve as a reinforcement and transmit the load toward the lateral flanges. However, by means of a modification of the flanges [as illustrated in U.S. application Ser. No. 401,963 filed Sept. 28, 1973, now U.S. Pat. No. 4,003,177, are bent, for instance, in semicurcular or semirectangular form] in this invention they can support greater loads since these flanges have deformations on their surface or a series of longitudinal, transversal or inclined corrugations, which combined provide a truly remarkable rigidity.

As mentioned above, a series of grooves, canals or deformations formed in transversal direction on the surface of these modular members, which are changes that are disclosed in the application mentioned above.

Figure 1:
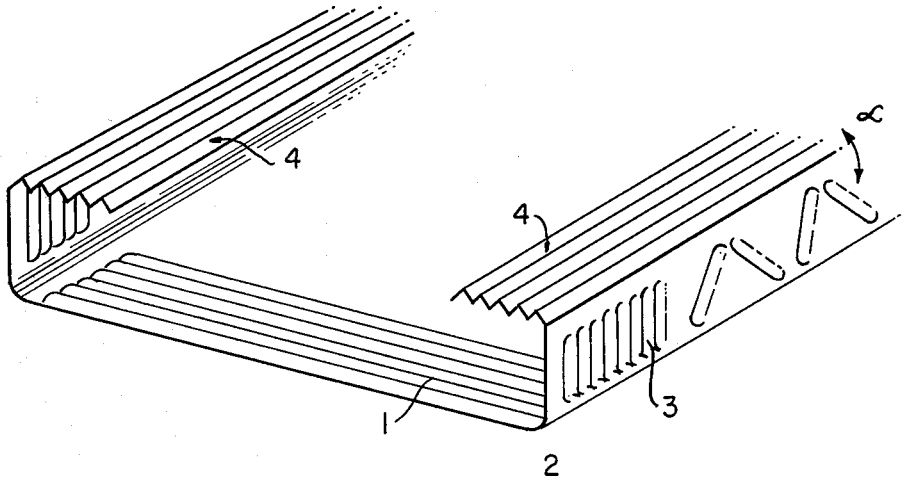
FIG. 1 is a view in perspective of a preferred embodiment of the modular covering member of the present invention.
Figure 3:
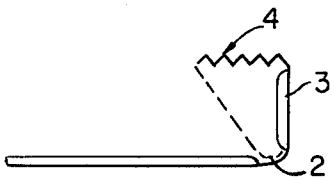
FIG. 3 is an end view of the member in FIG. 1 with a portion thereof broken away and omitted.

The preferred embodiment of this invention as seen in FIGS. 1 and 3 show a generally channel-shape modular cover with a series of corrugations 1 extending transversely of the widest portion of the member. Corrugations 1 end when they approach where the module forms a bend 2 of 90° or thereabouts, forming consequently a slightly curved section free of any canal or corrugations. In some cases, however, a continuous corrugation is required as specified in the previously mentioned patent application.

Figure 2:
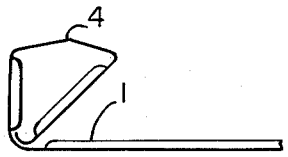
FIG. 2 is an end view of one side of a second embodiment of this invention with one side thereof broken away and omitted.

In a module member with a perpendicular section, which has a height that may vary with respect to the width and length thereof, a series of grooves, flutes or deformations 3 may be provided to extend perpendicularly or inclined with relation to the widest part of the module member as seen in FIG. 1, such are grooves 3 formed in the vertical portions extending from bend 2 having no corrugations to the portion where the module member again has another bend of for instance more or less 135° and from which bend extends portions 4 generally parallel to the widest portion of the module member. The portions 4 are formed with several longitudinal corrugations therein of a width proportional to the size of the module. In an alternative embodiment a single wide corrugation 4 may be provided as shown in FIG. 2 instead of several as in FIG. 3. Also, when there are several corrugations 4 as in FIG. 3, they may be smaller.

These modules, when placed in the ideal working position as in the form illustrated in the drawings, can also be placed in inversed direction, to function mainly with the corrugations 3 functioning best under compression; the corrugations 1 functioning under tension-compression; and the corrugations 4 functioning best under compression.

The flanges with the semicircular or semirectangular form consequently increase the momentum of inertia or section of module characteristic of each part.

Figure 4:
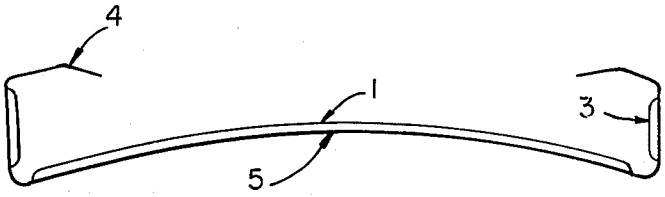
FIG. 4 is an end view of another embodiment according to the present invention.
Figure 5:
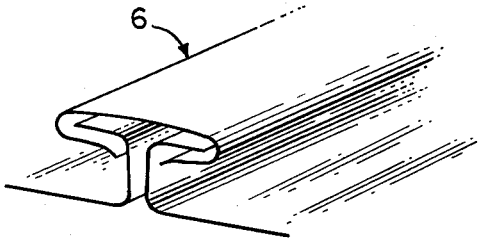
FIG. 5 is a schematic view in perspective showing the general arrangement of an anchor or connector member with two modular members according to the present invention.

Covering members, as disclosed herein, can be used as was specified in the patent application mentioned above; i.e., they can be placed together one after the other until they cover the desired area. These members can then be secured together, as seen in FIG. 5 by using a longitudinal piece 6 with the form of a half stem or of any other form, which is inserted or placed along all of the flanges in such a way that it tightly covers the joint and operates to hold it together. In some cases, it is used as a structural load element. The union of the supporting beams is obtained as mentioned in the patent application mentioned above by means of an anchor that goes through the members to be united and surrounds both flanges as if it was an inverted anchor, and holds them firmly without having to drill or form holes in them.

Where maximum rigidity is desired the covering can be deformed at 5 in order to give it a convex form as shown in FIG. 4. In this case, the corrugations 1 will be curved on the under surface.

As mentioned, these covering members have such a good rigidity that they can, when considered convenient, be made of a single piece in a length corresponding to the length of the area to be covered, which is not the case with the standard covering, available only in relatively short or limited lengths due to their lack of the proper rigidity. Consequently, some of all of the intermediate jamb posts, according to the area, can be eliminated. Several pieces, however, may be joined or overlapped in the longitudinal ends with members of this type.

An additional advantage is noted in that when the flanges are united, they serve as load elements or beams, and consequently there are less supporting elements, which also makes it possible to save a great amount of material, installation time and money.

It should be noted that the flanges of each module member will have a size proportional to the weight of said members, to the surface to be covered and/or the load to be supported.

If it is desired to unite among themselves these coverings members in a permanent way, this can be effected in a form different from the one described, that is, they may be welded or by any other procedure that would unite the vertical walls of the flanges of the coverings, between themselves.

It is understood that the foregoing description is not the intention to limit the rights of the inventor strictly to the letter of said description, as it is possible to make several changes that do not modify the basic concept of the invention.

What is claimed is:

1. A modular member which may be used individually or together with like members joined together to provide a separable reinforced hermetic covering comprising a generally longitudinally extending main portion, a plurality of corrugations extending transversely of said main portion adjacent at least one end thereof and stopping short of the opposite sides of said main portion, said main portion extending to a bend free of corrugations at each side thereof beyond the extent of said transversely extending corrugations, integral flange portions extending generally at from about 90°–135° to said main portion from said bend, a plurality of corrugations extending in said flange portion at about 90°–135° to said main portion and in the vicinity of at least one end of said flange portion, said corrugations in said flange portion stopping short of opposite sides thereof, each of said flange portions extending to a bend free of corrugations beyond the extent of the corrugations of said flange portions and continuing to an inwardly directed portion generally parallel to and overlying said main portion, said inwardly directed portions each having a plurality of corrugations in its surface extending longitudinally for the length of the respective inwardly directed portion and perpendicularly to said corrugations in said main portion.

2. The modular member of claim 1 wherein said flange portions include grooves or flutes extending on the surface thereof longitudinally inwardly of said plurality of corrugation in said flange portions and at intersecting angles thereto.

3. The modular member of claim 2 wherein additional modular members may be situated side by side with said flange portions in contact with adjacent flange portions of said additional modular members, anchoring means holding said modular members joined together at adjacent flange portions to provide a hermetically joined covering.

* * * * *